US009812278B2

(12) United States Patent
Iwata et al.

(10) Patent No.: US 9,812,278 B2
(45) Date of Patent: Nov. 7, 2017

(54) COMPLEX TYPE FUSIBLE LINK, FUSE BOX, AND MANUFACTURING METHOD THEREOF

(71) Applicant: YAZAKI CORPORATION, Tokyo (JP)

(72) Inventors: Masashi Iwata, Makinohara (JP); Norio Matsumura, Makinohara (JP); Tatsuya Aoki, Makinohara (JP); Kenya Takii, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 239 days.

(21) Appl. No.: 14/230,700

(22) Filed: Mar. 31, 2014

(65) Prior Publication Data

US 2014/0218160 A1 Aug. 7, 2014

Related U.S. Application Data

(62) Division of application No. 13/606,969, filed on Sep. 7, 2012, now Pat. No. 9,007,164, which is a division (Continued)

(30) Foreign Application Priority Data

Sep. 5, 2008 (JP) ..... 2008-228578

(51) Int. Cl.
*H01H 85/143* (2006.01)
*H01H 69/02* (2006.01)

(Continued)

(52) U.S. Cl.
CPC ..... *H01H 85/143* (2013.01); *H01H 69/02* (2013.01); *H01H 85/044* (2013.01);

(Continued)

(58) Field of Classification Search
CPC .... H01H 85/044; H01H 85/143; H01H 69/02; H01H 85/08; H01H 2085/266; H01H 85/175; H01H 85/47; H01H 2085/0555

(Continued)

(56) References Cited

U.S. PATENT DOCUMENTS 4,689,597 A * 8/1987 Galloway ..... H01H 85/0411 29/623
5,346,411 A 9/1994 Nikkinen (Continued)

FOREIGN PATENT DOCUMENTS

DE 296 20 424 U1 2/1997
DE 10 2009 034 040 A1 2/2010

(Continued)

OTHER PUBLICATIONS

German Office Action dated Aug. 13, 2010 in the corresponding German Patent Application No. 102009038420.0.

(Continued)

*Primary Examiner* — Anatoly Vortman
(74) *Attorney, Agent, or Firm* — Sughrue Mion, PLLC

(57) ABSTRACT

A complex type fusible link which includes an insulative block base including a plurality of cavities; a conductive connecting plate which is integrally embedded in the insulative block base, a part of the conductive connecting plate being exposed to at least one of the cavities; a plurality of fusible elements each of which is accommodated in corresponding one of the cavities and includes a first end which is connected to the part of the conductive connecting plate and a second end; and a plurality of terminals each of which is integrally embedded in the insulative block base and includes a first end which is connected to the second end of corresponding one of the fusible elements and a second end which is exposed from the insulative block base, at least one (Continued)

of the fusible elements includes a fastening portion to which another fusible element is fastened.

10 Claims, 14 Drawing Sheets

Related U.S. Application Data of application No. 12/550,037, filed on Aug. 28, 2009, now abandoned.

(51) Int. Cl.

| | |
|---|---|
| ***H01H 85/044*** | (2006.01) |
| *H01H 85/08* | (2006.01) |
| *H01H 85/175* | (2006.01) |
| *H01H 85/47* | (2006.01) |
| *H01H 85/055* | (2006.01) |
| *H01H 85/26* | (2006.01) |

(52) U.S. Cl.
CPC ..... *H01H 85/08* (2013.01); *H01H 85/175* (2013.01); *H01H 85/47* (2013.01); *H01H 2085/0555* (2013.01); *H01H 2085/266* (2013.01); *Y10T 29/49107* (2015.01); *Y10T 29/49117* (2015.01); *Y10T 29/49124* (2015.01); *Y10T 29/49155* (2015.01)

(58) Field of Classification Search
USPC ..... 337/159, 187, 227, 290, 296; 29/623
See application file for complete search history.

(56) References Cited

U.S. PATENT DOCUMENTS

| | | | | |
|---|---|---|---|---|
| 5,643,693 | A | 7/1997 | Hill et al. | |
| 5,645,448 | A | 7/1997 | Hill | |
| 5,886,611 | A * | 3/1999 | Schaller | H01H 85/044 337/187 |
| 5,977,859 | A | 11/1999 | Kawamura et al. | |
| 6,294,978 | B1 | 9/2001 | Endo et al. | |
| 6,457,995 | B1 | 10/2002 | Brooks | |
| 6,476,705 | B1 | 11/2002 | Betti et al. | |
| 6,509,824 | B2 | 1/2003 | Inaba et al. | |
| 6,512,443 | B1 | 1/2003 | Matsumura et al. | |
| 6,520,804 | B2 | 2/2003 | Sumida et al. | |
| 6,558,198 | B2 | 5/2003 | Kobayashi et al. | |
| 6,566,599 | B2 | 5/2003 | Sumida et al. | |
| 6,580,032 | B2 | 6/2003 | Sumida et al. | |
| 6,624,356 | B2 | 9/2003 | Sumida et al. | |
| 6,759,938 | B2 | 7/2004 | Matsumura et al. | |
| 6,806,421 | B2 | 10/2004 | Matsumura | |
| 6,824,430 | B2 | 11/2004 | Matsumura et al. | |
| 6,830,482 | B2 | 12/2004 | Matsumura et al. | |
| 7,046,115 | B2 | 5/2006 | Higuchi et al. | |
| 7,176,780 | B2 | 2/2007 | Iwata | |
| D560,172 | S * | 1/2008 | Ohta | D13/161 |
| 7,420,453 | B2 | 9/2008 | Matsumura et al. | |
| 7,568,921 | B2 * | 8/2009 | Pavlovic | H01H 85/0417 439/620.26 |
| 7,663,465 | B2 * | 2/2010 | Matsumoto | H01H 85/044 337/187 |
| 2001/0050608 | A1 | 12/2001 | Evans et al. | |
| 2002/0064999 | A1 | 5/2002 | Kobayashi et al. | |
| 2002/0163416 | A1 | 11/2002 | Matsumura | |
| 2010/0019572 | A1 | 1/2010 | Kudo et al. | |

FOREIGN PATENT DOCUMENTS

| | | | |
|---|---|---|---|
| GB | 2 375 443 | A | 11/2002 |
| JP | 4131845 | U | 12/1992 |
| JP | 2000-195408 | A | 7/2000 |
| JP | 2002175755 | A | 6/2002 |
| JP | 2002329457 | A | 11/2002 |
| JP | 2002-358866 | A | 12/2002 |
| JP | 2004127696 | A | 4/2004 |
| JP | 2004-186006 | A | 7/2004 |
| JP | 2007294354 | A | 11/2007 |

OTHER PUBLICATIONS

Office Action dated Oct. 30, 2012 issued by the Japanese Patent Office in counterpart Japanese Application No. 2008-228578.

* cited by examiner

RELATED ART

COMPLEX TYPE FUSIBLE LINK, FUSE BOX, AND MANUFACTURING METHOD THEREOF

CROSS-REFERENCE TO RELATED APPLICATIONS

This application is a divisional application of U.S. patent application Ser. No. 13/606,969, filed Sep. 7, 2012, which is a continuation of U.S. patent application Ser. No. 12/550,037, filed Aug. 28, 2009, now abandoned, which claims priority from Japanese Patent Application No. 2008-228578 filed on Sep. 5, 2008, and the entire subject matters of which are incorporated herein by reference.

TECHNICAL FIELD

This invention relates to a complex type fusible link having a plurality of fusible elements, a fuse box and a manufacturing method thereof.

BRIEF DESCRIPTION OF THE RELATED ART

One related fuse box for being directly mounted on a battery is disclosed, for example, in JP-A-2000-195408. More specifically, this fuse box includes a plurality of blade fuses, and a synthetic resin box on which blade fuse-mounting portions are provided by blocking out. An input terminal for connection to the battery is beforehand mounted in the box, and is exposed at one side portions of the mounting portions. Each blade fuse is mounted in the corresponding mounting portion of the box, and one end of the blade fuse is screw fastened to the input terminal, while a ring terminal press-clamped to a wire is screw fastened to the other end of the blade fuse. In this fuse box, however, particularly the blade fuses are provided as separate single parts, and therefore is individually mounted and screw-fastened, and this mounting or assembling operation has been rather cumbersome.

Therefore, in order to mainly improve the mounting or assembling efficiency, there has been proposed a fuse device of the type in which input and output terminals and fuse elements are formed integrally with each other. Namely, one bus bar is press-worked to provide an integral or one-piece structure including an input terminal portion, a plurality of tab-like output terminals and a plurality of fuse elements each interconnecting the input terminal portion and the corresponding output terminal portion, and then a resin-molded portion is formed around the fuse elements such that the fuse elements are exposed. This fuse device is received within a box, and the input terminal portion is connected to a battery, while mating terminals each fixedly secured to an end portion of a wire are fittingly connected respectively to the output terminals, and in this condition the fuse device is used.

In this fuse device, when an electric current of above a predetermined level flows through a circuit connected to any of the output terminals, the corresponding fuse element melts. In this case, there is a possibility that debris resulting from the melted fuse element is scattered, and deposits on other fuse elements to cause such other fuse elements to unnecessarily melt. Therefore, it has been desired to further improve the fuse device.

Therefore, as shown in FIG. 14, there has been proposed a structure in which vertically-extending ribs 103 and 103A each disposed between adjacent fuse elements 102 are formed on opposite (front and rear) faces of a resin-molded portion 101 of a fuse device 100, and partition walls 203 each having a fitting groove 202 at its widthwise central portion are formed on opposed walls or surfaces of an insertion space 201 of a box 200, and the ribs 103 can be fitted in the respective fitting grooves 202, while distal ends of the ribs 103A of a larger projecting height can be fitted respectively in vertically-extending guide grooves 204 (see, for example, JP-A-2002-358866). In this fuse device 100, any two adjacent fuse elements 102 are perfectly separated or isolated from each other by the ribs 103, 103A and the partition wall 203 which serve as protection walls, and therefore even when any of the fuse elements 102 melts, debris resulting from the melted fuse element 102 is prevented from being scattered toward other fuse elements 102, thus preventing such other fuse elements 102 from unnecessary melting.

In this related fuse device, with respect to the integral construction having the connecting plate portion, the fusible element portions and the output (connector) portions, there is usually a dimensional difference between the required pitch of arrangement of the fusible elements and the pitch of the output portions limited or required by the configuration of the connector. Therefore, in the case of producing the component parts of the fuse device and for example, in a method of forming these parts by press-cutting, a yield is lowered. Namely, when the press-cutting (hollowing) operation is performed in accordance with the required pitch of arrangement of the fusible elements, there is encountered a disadvantage that a complicated or wasteful arrangement is made so as to meet a special design of the output connector or a demand of the output side.

SUMMARY

The present invention has been made in view of the above circumstances, and an object of the invention is to provide a complex type fusible link, a fuse box and a manufacturing method thereof, in which the fusible link can be manufactured in such a manner that its performance corresponding to a use specific application can be meticulously set, and a yield of a bus bar can be enhanced.

The first aspect of the invention is a complex type fusible link which includes an insulative block base including a plurality of cavities; a conductive connecting plate which is integrally embedded in the insulative block base, a part of the conductive connecting plate being exposed to at least one of the cavities; a plurality of fusible elements each of which is accommodated in corresponding one of the cavities and includes a first end which is connected to the part of the conductive connecting plate and a second end; and a plurality of terminals each of which is integrally embedded in the insulative block base and includes a first end which is connected to the second end of corresponding one of the fusible elements and a second end which is exposed from the insulative block base.

In the complex type fusible link according to the first aspect of the invention, suitable materials and suitable material thicknesses are selected for the connecting plate portion, the output portion and the fusible elements, and by doing so, a compact design and a low-cost design can be achieved. Also, the complex type fusible link can be manufactured such that performance corresponding to a specific application can be meticulously set, and a yield of a bus bar can be enhanced.

The second aspect of the present invention is a complex type fusible link according to the first aspect, in which the first and the second end of at least one of the fusible elements are distant in a direction perpendicular to the conductive connecting plate.

In the complex type fusible link according to the second aspect of the invention, at least one fusible element, when viewed obliquely from the upper side of the exterior, can be visually confirmed clearly, and therefore whether or not each fusible element is melted can be easily confirmed with the eyes.

The third aspect of the present invention is a complex type fusible link according to the first or the second aspect, in which at least one of the fusible elements includes a fastening portion to which another fusible element is fastened.

In the complex type fusible link according to the third aspect of the invention, when any of the fusible elements melts, a new fusible element can be easily attached to this melted fusible element, utilizing the fastening means. Therefore, a cumbersome operation, for example, for connecting wires to the new fusible element is not necessary.

The fourth aspect of the present invention is a complex type fusible link according to the first, the second or the third aspect, in which the block base has a fin.

In the complex type fusible link according to the fourth aspect of the invention, a heat radiating effect can be enhanced by the fin portion.

The fifth aspect of the present invention is fuse box which includes a complex type fusible link including: an insulative block base including a plurality of cavities; a conductive connecting plate which is integrally embedded in the insulative block base, a part of the conductive connecting plate being exposed to at least one of the cavities; a plurality of fusible elements each of which is accommodated in corresponding one of the cavities and includes a first end which is connected to the part of the conductive connecting plate and a second end; and a plurality of terminals each of which is integrally embedded in the insulative block base and includes a first end which is connected to the second end of corresponding one of the fusible elements and a second end which is exposed from the insulative block base, wherein the first and the second end of at least one of the fusible elements are distant in a direction perpendicular to the conductive connecting plate; and a transparent cover which covers the complex fusible link from outside thereof.

In the fuse box according to the fifth aspect of the invention, suitable materials and suitable material thicknesses are selected for the connecting plate portion, the output portion and the fusible elements of the complex type fusible link, and by doing so, the compact design and the low-cost design can be achieved, and also the complex type fusible link can be manufactured in such a manner that its performance corresponding to a specific application can be meticulously set, and the yield of the bus bar can be enhanced.

The sixth aspect of the present invention is a manufacturing method of a complex fusible link which includes: a hollowing process to hollow out a conductive plate into a link-like conductor including a connecting plate and a terminal; a cutting out process to cut out the link-like conductor so as to separate the connecting plate and the terminal; an insert molding process to form a block base including a cavity after setting the connecting plate and the terminal in a mold; and a connecting process to electrically connect a fusible element to the cavity.

In the complex type fusible link-manufacturing method according to the sixth aspect of the invention, suitable materials and suitable material thicknesses are selected for the connecting plate portion, the output portion and the fusible elements of the complex type fusible link, and by doing so, the compact design and the low-cost design can be achieved, and also the complex type fusible link can be manufactured in such a manner that its performance corresponding to a specific application can be meticulously set, and the yield of the bus bar can be enhanced.

According to the above mentioned one or more illustrative aspects of the present invention, the compact design of the complex type fusible link can be achieved, and the complex type fusible link can be manufactured in such a manner that its performance corresponding to a specific application with this fusible link can be set, and a yield of the bus bar can be enhanced.

DETAILED DESCRIPTION OF EXEMPLARY EMBODIMENTS OF THE PRESENT INVENTION

Exemplary embodiments of the present invention will now be described in detail with reference to the accompanying drawings.

First Exemplary Embodiment

Figure 1A:
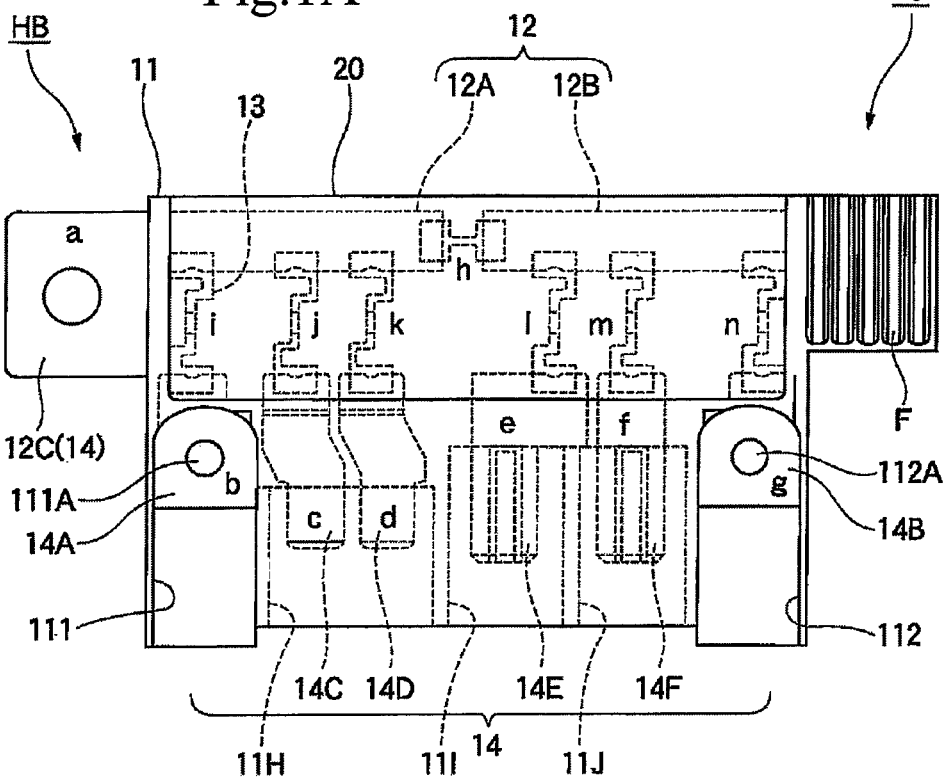
FIG. 1A is a front-elevational view of a first exemplary embodiment of a fuse box of the present invention.
Figure 1B:
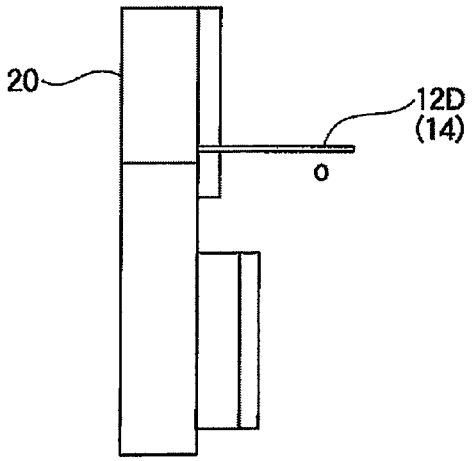
FIG. 1B is a side-elevational view thereof as seen from a right end face thereof.
Figure 2:
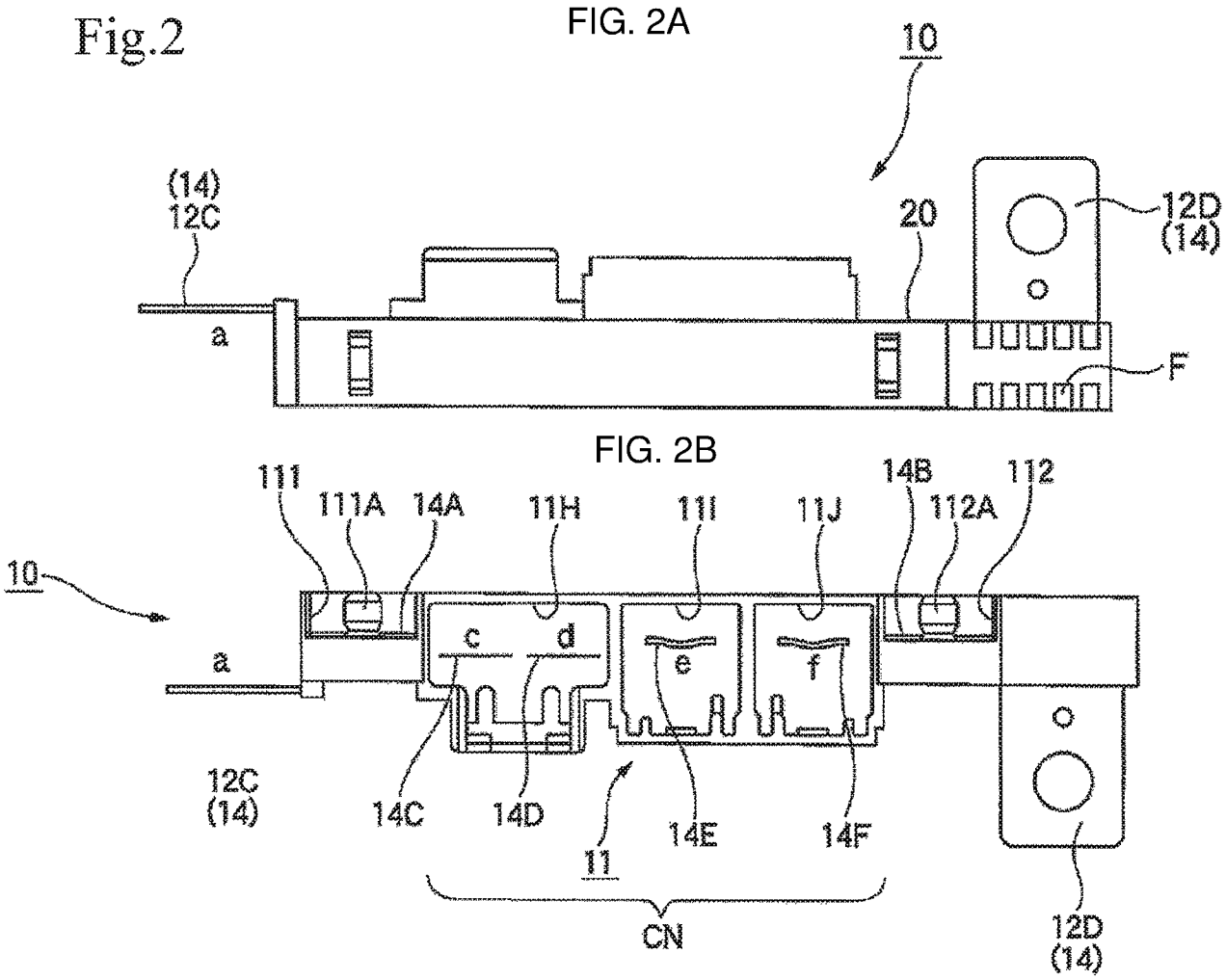
FIG. 2A is a plan view of the fuse box.
FIG. 2B is a bottom view thereof.
Figure 3:
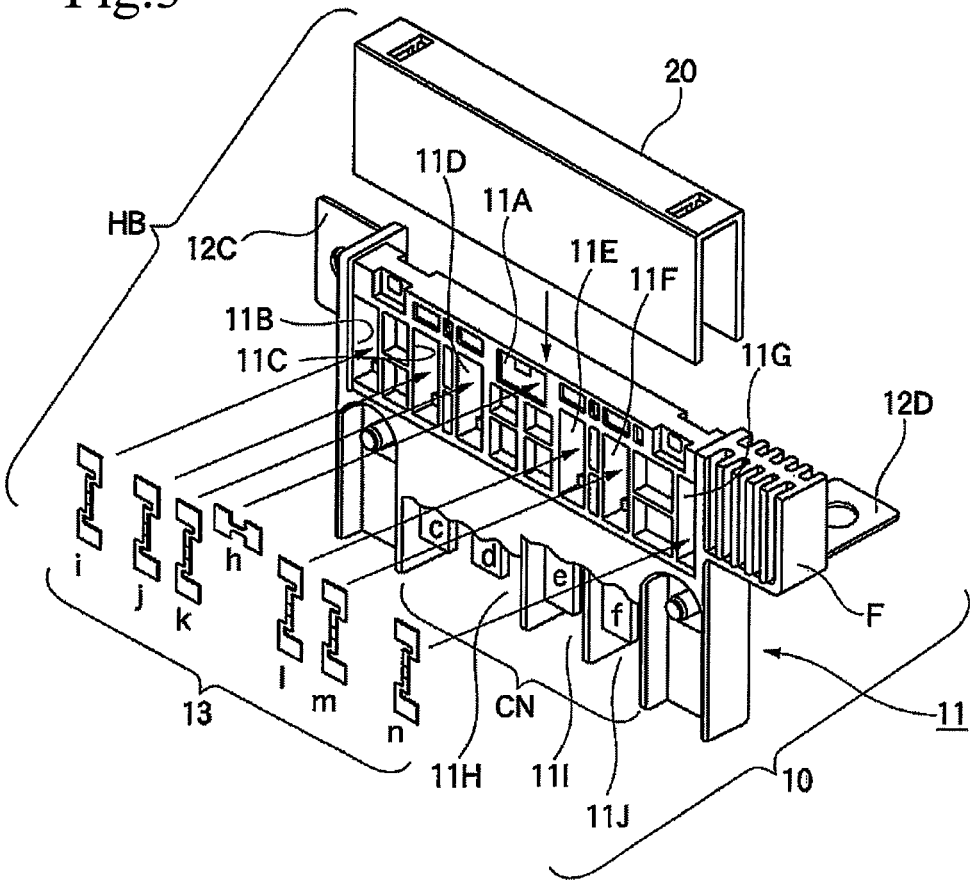
FIG. 3 is an exploded perspective view of the fuse box.

FIGS. 1 to 3 show a fuse box HB comprising a first exemplary embodiment of a complex type fusible link 10 of the invention and a cover 20 fitted on the complex type fusible link 10. The fuse box HB is installed in a power box (not shown) of a vehicle. The complex type fusible link 10 includes a block base portion 11, a connecting plate portion 12, fusible elements 13, terminals 14, and a fin portion F.

The complex type fusible link 10 is constructed as a fuse device (for electronic parts mounted on the vehicle) disposed between a bus bar (forming the connecting plate portion 12) for connection to a battery mounted on the vehicle and electrically-connecting portions (forming the terminals 14) for connection to wires (wire harness) connecting the various electronic parts (hereinafter referred to as "electrical equipments") to the battery. In this embodiment, the complex type fusible link 10 is mounted within the vehicular power box as described above.

The block base portion 11 is formed of an insulative resin, and the connecting plate portion 12 and the terminals 14 are mostly embedded in the block base portion 11 by insert molding. Fusible element-receiving portions 11A to 11G (each in the form of a recess and one exemplary embodiment of cavities) for respectively receiving the fusible elements 13 (described later) are formed in the block base portion 11, and also the fin portion F having a number of air-cooling fins for promoting the radiation and dissipation of Joule heat generated from the connecting plate portion 12 and the terminals 14 is formed integrally on the block base portion 11. Recess portions 111 and 112 for the screw fastening of ring terminals (not shown) are formed respectively at opposite (left and right) end portions of the block base portion 11.

Further, a female type connector CN to which a male type connector (connected to the wires (wire harness) for connecting the electrical equipments respectively to terminals c to f (described later)) can be connected is formed integrally on the block base portion 11. Connector chambers 11H to 11J are formed in the connector CN.

The connecting plate portion 12 is made of an electrically-conductive material such as a metal plate, and is integrally embedded in the block base portion 11, with its opposite end portions (terminals a and o) exposed. This connecting plate portion 12 forms the bus bar. Holes are formed respectively through the opposite end portions of the connecting plate portion 12, and wire-connected terminals (ring terminals) are adapted to be screw fastened to these holes, respectively.

More specifically, in this embodiment, the connecting plate portion 12 is divided into two plate portions which are electrically interconnected by the fusible element h. One (hereinafter referred to as "first connecting plate portion 12A) of the two plate portions is integrally embedded in the block base portion 11 by insert molding or other means, with a tongue-like metal portion (end portion) 12C (forming the terminal a for connection to the ring terminal) exposed. Also, the other plate portion (hereinafter referred to as "second connecting plate portion 12B) is integrally embedded in the block base portion 11 by insert molding or other means, with a tongue-like metal portion (end portion) 12D (forming the terminal o for connection to the ring terminal) exposed.

The fusible elements 13 are mounted or received respectively in the fusible element-receiving portions 11A to 11G formed at the block base portion 11. Each fusible element 13 melts upon flowing of an over-current of a predetermined level therethrough, thereby protecting the corresponding electrical equipment. The fusible elements 13 are so mounted in the respective fusible element-receiving portions 11A to 11G that when any of these fusible elements 13 melts, it can be replaced with a new one. In this embodiment, seven kinds of fusible elements 13 (that is, the fusible elements h to n) are mounted in the fusible element-receiving portions 11A to 11G, respectively.

In FIG. 1, the terminals 14 comprise two terminals 14A and 14B for connecting ring terminals and exposed to one face of the block base portion 11, and four connector connecting terminals 14C, 14D, 14E and 14F embedded in the block base portion 11 such that one end portions (lower end portions) are exposed at the respective connector chambers 11H, 11I and 11J formed at a lower portion of the block base portion 11. Like the connecting plate portions 12A and 12B, the terminals 14A and 14F are mostly embedded integrally in the block base portion 11, and therefore these terminals 14A to 14F are insert molded in the block base portion 11. The other end portions (upper end portions in FIG. 1) of the terminals 14A and 14B are exposed respectively at the fusible element-receiving portions 11B and 11G, and the other end portions (upper end portions) of the terminals 14C to 14F are exposed respectively at the fusible element-receiving portions 11C to 11F.

Therefore, in this embodiment, suitable materials and suitable material thicknesses can be properly selected for the connecting plate portions 12A and 12B, the terminals 14 and the fusible elements 13, and therefore a compact design and a low heat-generating design can be easily achieved. Particularly, the complex type fusible link can be manufactured in such a manner that its performance corresponding to a specific application can be meticulously set, and the yield of the bus bar can be enhanced.

Next, a method of manufacturing the complex type fusible link 10 of this embodiment will be described.

As shown in FIG. 5, the method of manufacturing the complex type fusible link 10 of the invention includes a first step S1 of hollowing from a metal plate a link-like conductor 15 (see FIG. 6) of an integral or one-piece construction corresponding to the connecting plate portion 12 and the terminals 14, a second step S2 of severing or separating the connecting plate portions 12A and 12B and the terminals 14 of the link-like conductor 15 from one another, a third step S3 of setting the separated connecting plate portion 12 and terminals 14 in a mold and effecting an insert molding operation to form the block base portion 11 serving as the body portion of the complex type fusible link, and a fourth step S4 of mounting the fusible elements 13 respectively in the fusible element-receiving portions 11A to 11G of the block base portion 11 in an electrically-connected condition.

In the first step S1, the intermediate product sheet (hereinafter referred to as "link-like conductor") 15 of an integral or one-piece construction is hollowed from the predetermined metal plate (for example, a metal plate of a generally rectangular shape shown in FIG. 6) by pressing or other means.

Figure 6:
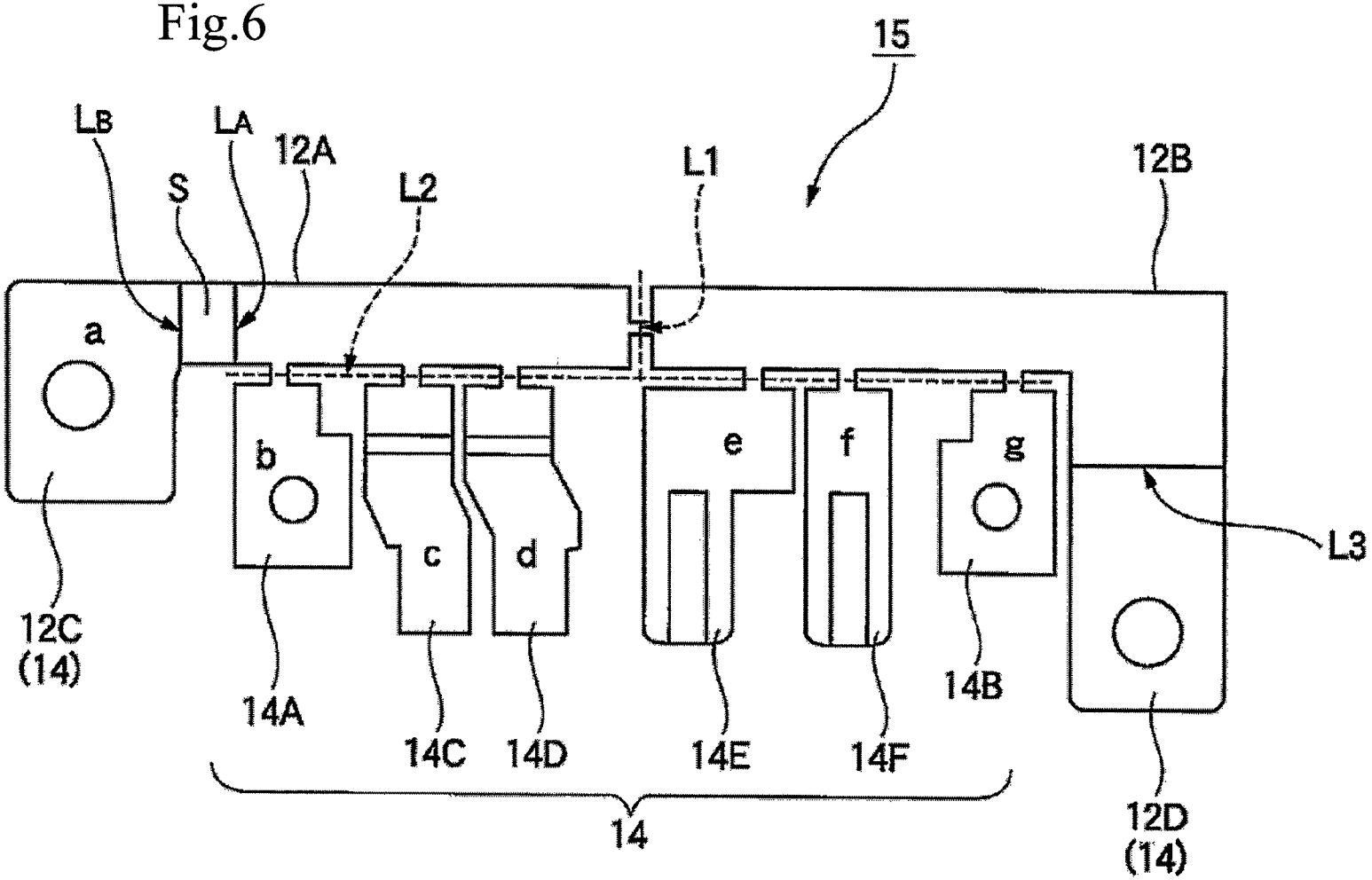
FIG. 6 is a plan view of a link-like conductor used in the manufacture of the fuse box.

In the second step S2, the connecting plate portion 12 of the link-like conductor 15 of FIG. 6 is cut at its central portion along a line L1 to be divided into two connecting plate portions 12A and 12B. The terminals 14A, 14C and 14D are integrally connected with the connecting plate portion 12A through respective thread-like interconnecting portions, while the terminals 14E, 14F and 14B are integrally connected with the connecting plate portion 12B through respective thread-like interconnecting portions, and therefore these thread-like interconnecting portions are cut along a line L2. Further, in order that a rectangular portion S of the connecting plate portion 12A can form a step portion, that is, can be disposed perpendicularly to the sheet of FIG. 6, the connecting plate portion 12A is right-angularly bent into a generally inverted V-shape along a line LA (FIG. 6), and then is right-angularly bent into a generally V-shape along a line LB to form a right-angular crank-shape. The other connecting plate portion 12B is bent perpendicularly downwardly from the sheet of FIG. 6 along a line L3, that is, bent into a generally inverted V-shape. In this embodiment, although the order of the above cutting (or severing) operations and the above bending operations are not particularly determined, it is preferred that the order be so determined that these operations can be carried out efficiently.

In the third step S3, the connecting plate portions 12A and 12B and the terminals 14A to 14F (which have been separated from one another in the second step S2) are set in the mold (not shown), and then a predetermined insulative resin is injected or poured into the mold, thereby effecting the insert molding operation. As a result, the block base portion 11 having the connecting plate portions 12A and 12B and the terminals 14A to 14F integrally embedded therein (in such a manner that part of each of these portions is exposed) is obtained. In the insert molding of the block base portion 11, the two connecting plate portions 12A and 12B and the six terminals 14A to 14F are set in the predetermined mold in such a manner that they are positioned and arranged in a manner shown in FIG. 5B. Namely, these inserts are arranged with their outer edges coinciding with longitudinal and transverse reference lines LX, LY1 and LY2, and merely by doing so, the inserts can be accurately positioned.

The fusible element-receiving portions 11A to 11G (each in the form of a recess) for respectively receiving the fusible elements are formed in the one face (front face in FIG. 5C) of the thus obtained block base portion 11, and are arranged at predetermined pitches in generally closely spaced relation to one another, and the three connector chambers 11H to 11J are formed in the lower portion (FIG. 5C) of the one face of the block base portion 11 in adjoining relation to one another (The connector chambers 11H to 11J do not always need to be arranged at the same pitch). The recess portions 111 and 112 are formed in the block base portion 11, and projections 111A and 112A projecting respectively into holes of the terminals 14A and 14B exposed to the front face (in FIG. 5C) (in which the fusible element-receiving portions 11A to 11G are formed) are formed within the recess portions 111 and 112, respectively. After the complex type fusible link is completed, the ring terminals (not shown) are mounted in the recess portions 111 and 112, respectively.

In the fourth step S4, the fusible elements 13 beforehand prepared through pressing, wire cutting, laser cutting, etching or other means are electrically connected respectively to the fusible element-receiving portions 11A to 11G of the block base portion 11 molded in the third step S3. Each fusible element 13 has proper fuse characteristics (rating) so that an optimal maximum allowable current can flow at the corresponding fusible element-receiving portion 11.

Figure 4:
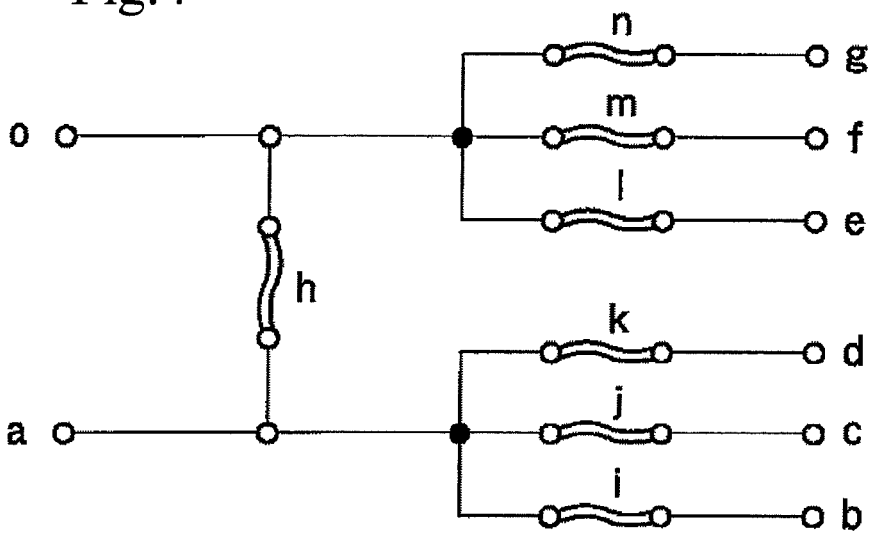
FIG. 4 is a wiring diagram of the fuse box.

One side edge portions of the connecting plate portions 12A and 12B and the end portions of the terminals 14A to 14F are exposed at the corresponding fusible element-receiving portions 11, and these side edge portions and end portions are connected to the corresponding fusible elements 13 received in the respective fusible element-receiving portions 11. The fusible elements 13 can be connected to these portions by any suitable method such as ultrasonic welding and laser beam welding. As a result, the link type fuse unit having a plurality of fuse circuits (see FIG. 4), that is, the complex type fusible link 10, is formed. When the cover 20 is fitted on this complex type fusible link 10, the fuse box HB shown in FIGS. 1 and 2 is completed.

Figure 5A:
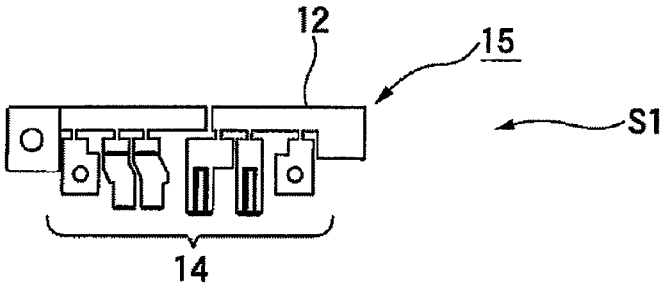
FIGS. 5A to 5D are views showing steps of a method of manufacturing the fuse box.
Figure 5B:
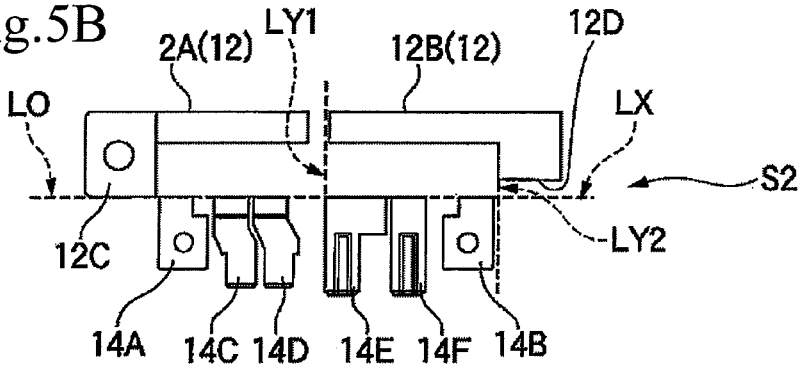
Figure 5C:
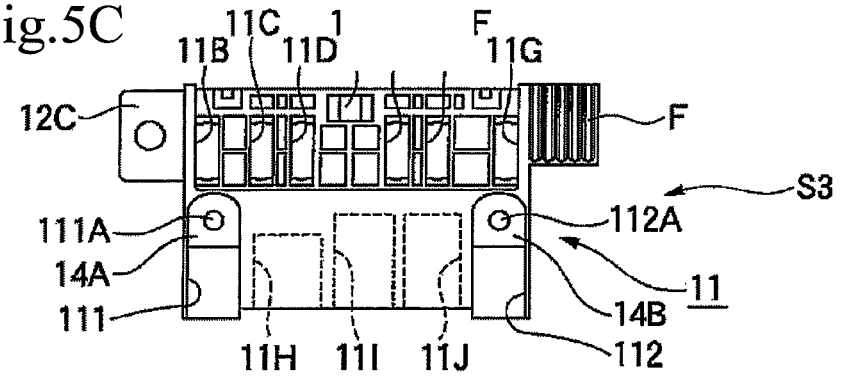
Figure 5D:
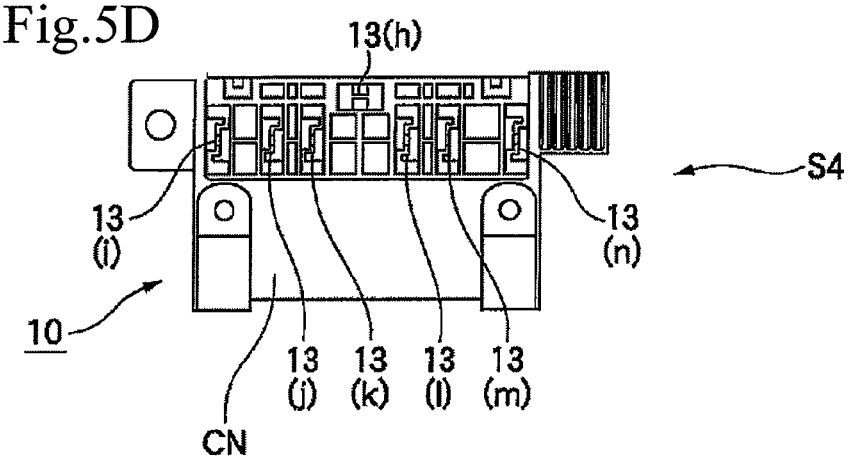

In the method of manufacturing the complex type fusible link 10 of this embodiment, when the block base portion 11 is to be insert molded, the inserts, that is, the two connecting plate portions 12A and 12B and the six terminals 14A to 14F, are set in the predetermined mold in such a manner that they are positioned and arranged in the manner shown in FIG. 5B. Namely, these inserts are arranged with their outer edges coinciding straight with the longitudinal and transverse reference lines LX, LY1 and LY2, and merely by doing so, the inserts can be accurately positioned.

In the method of manufacturing the complex type fusible link 10 of this embodiment, the terminals 14 and the connecting plate portion 12 are formed by the press-cutting (hollowing) of one metal plate, whereas the fusible elements 13 are manufactured separately from the terminals 14 and the connecting plate portion 12. The arrangement of the terminals 14C to 14F received in the respective connector chambers 11H to 11J is limited by the configuration of the connector, and therefore it is difficult to cause the pitch of arrangement of the fusible elements 13 to coincide with the pitch of arrangement of the connector chambers (that is, the pitch of the terminals 14A to 14F). Therefore, in the case where the terminals 14 are hollowed from one metal plate in integrally-connected relation to the fusible elements 13, wasteful areas which can not be used as the fusible elements 13 and the terminals 14 much develop because of the difference in the pitch between the terminals 14 and the fusible elements 13. In this embodiment, however, only the connecting plate portion 12 and the terminals 14 are formed separately from the fusible elements 13, and therefore such wasteful areas which can not be used will not develop, and this is economical. In addition, in case the terminals 14A to 14F and the connector chambers 11H to 11J are arranged in accordance with the pitch of arrangement of the fusible elements, there is encountered a disadvantage that a complicated or wasteful arrangement is made so as to meet a special design of the connector (output) side or a demand of the output side. In this embodiment, however, the terminals are formed separately from the fusible elements, and therefore such a disadvantage will not be encountered.

Second Exemplary Embodiment

Next, a second exemplary embodiment of the invention will be described with reference to the drawings.

Figure 7:
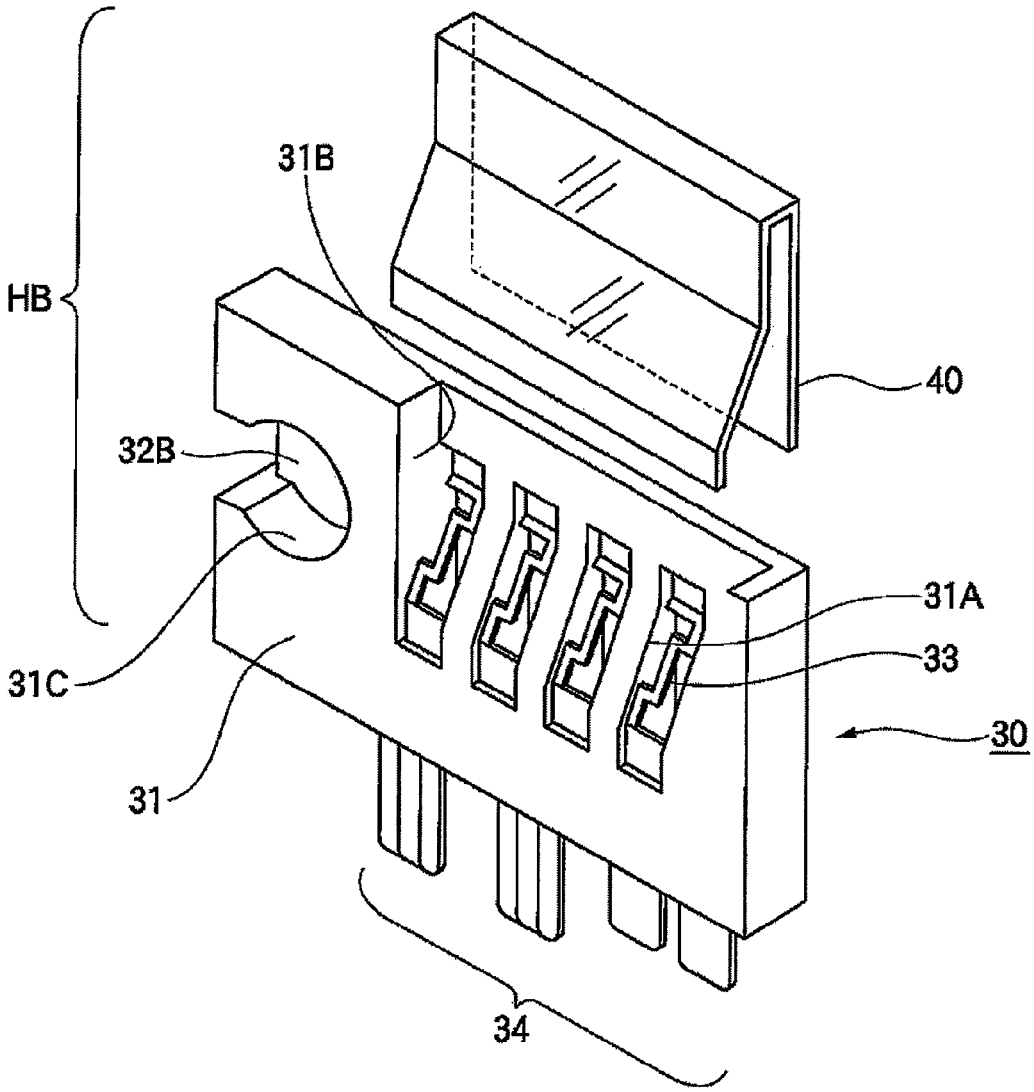
FIG. 7 is an exploded perspective view of a second exemplary embodiment of a fuse box of the invention.
Figure 8B:
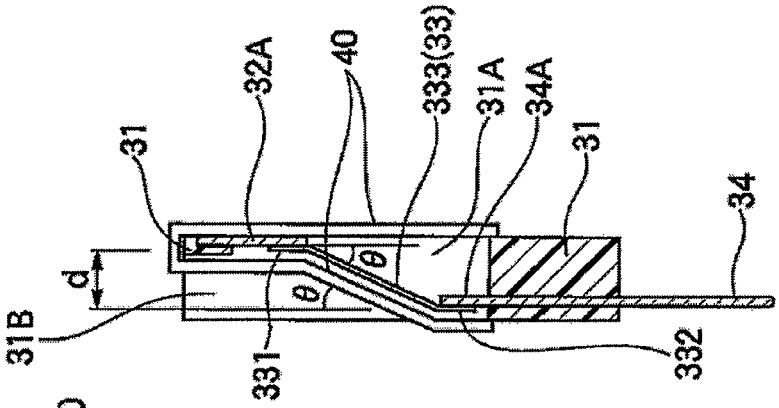
FIG. 8B is a side-elevational view thereof as seen from a right end face thereof.
Figure 8A:
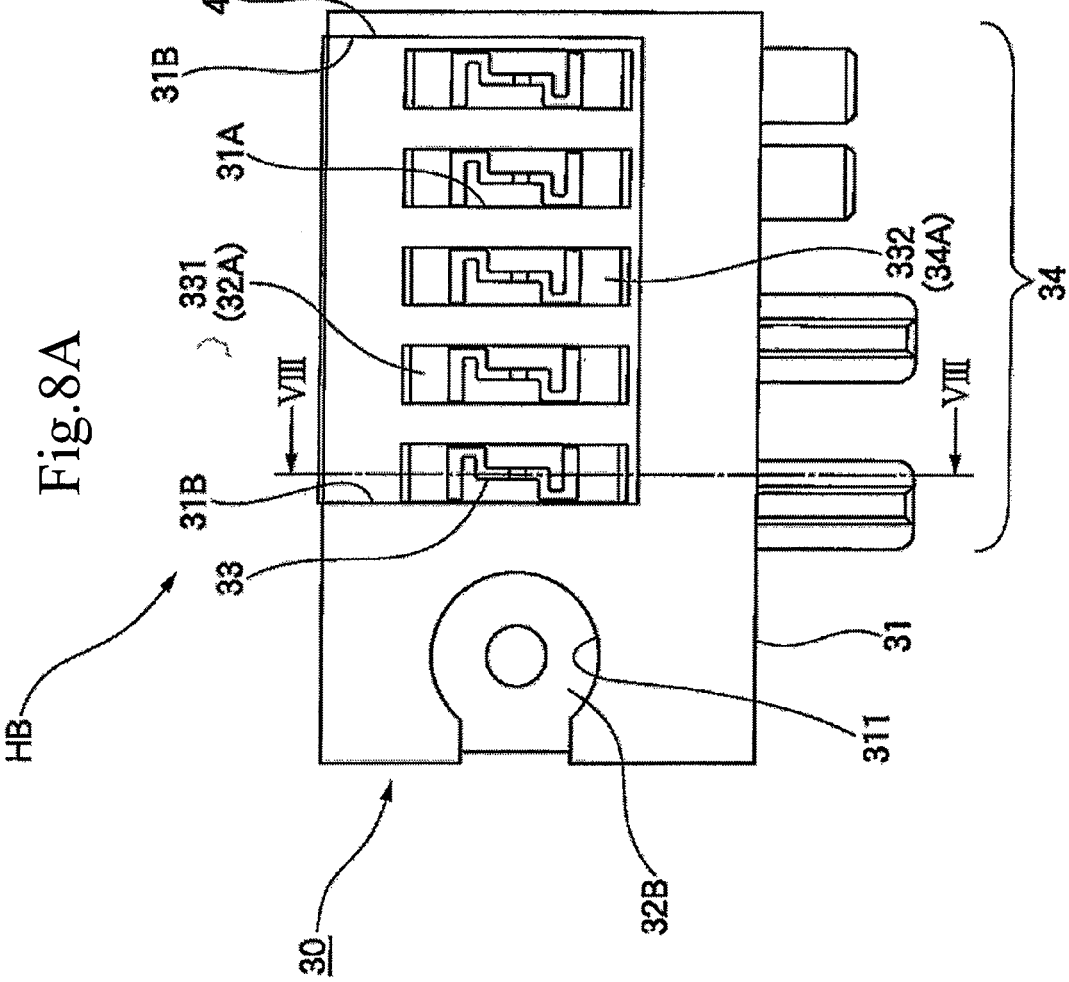
FIG. 8A is a front-elevational view of the fuse box of the second embodiment.
Figure 9:
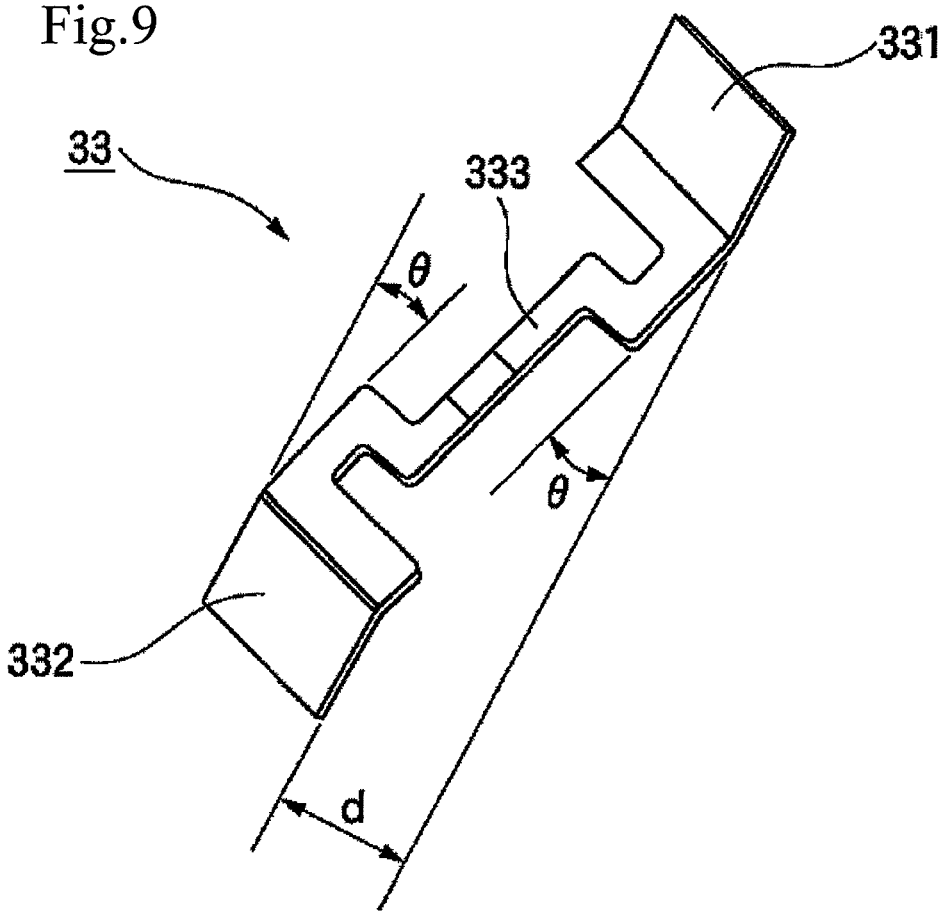
FIG. 9 is a perspective view of a fusible element used in a complex type fusible link of the fuse box of the second embodiment.

FIGS. 7 and 8 show a fuse box HB comprising a complex type fusible link 30 of the second exemplary embodiment and a transparent cover 40 fitted on the complex type fusible link 30. This fuse box HB is installed in a power box of a vehicle as in the first embodiment. The complex type fusible link 30 includes a block base portion 31, a connecting plate portion 32, fusible elements 33, and terminals 34.

Unlike the block base portion 11 of the first embodiment, the block base portion 31 of this embodiment does not have any connector chamber. One end portions of terminals forming the terminals 34 project outwardly from a lower surface (FIGS. 7 and 8) of the block base portion 11. That area of the block base portion 31 in which fusible element-receiving portions 31A are formed is entirely recessed to form a slit (or recess) 31B recessed one step from a face (front face in FIG. 7) of the block base portion 31, and the transparent cover 40 is detachably fitted on the block base portion 31, utilizing this slit (or recess) 31B. A recess 311 for the screw fastening of a ring terminal (not shown) is formed in one end portion of the block base portion 31, and one end portion 32B of the connecting plate portion 32 is exposed at this recess 311.

One side edge portion 32A (see FIG. 8) of the connecting plate portion 32 is exposed at the fusible element-receiving portions 31A of the block base portion 31 as in the first embodiment, and the one end portion 32B (see FIG. 8) thereof is exposed at the ring terminal-mounting recess 311 of the block base portion 31. As shown in FIG. 8, the connecting plate portion 32 is embedded in the block base portion 31 such that an embedding position of the connecting plate portion 32 is lower by an amount (height) d than an embedding position of the terminals 34 in a direction of the thickness of the block base portion 31.

In order that whether or not each fusible element 33, incorporated in the fuse box HB of FIG. 8 and hence received in the corresponding fusible element-receiving portion 31A, is melted can be easily confirmed with the eyes from an upper side of the exterior, an intermediate fusible portion 333 of each fusible element 33 is inclined at an angle θ such that two joint portions 331 and 332 formed respectively at the opposite ends of the fusible element 33 are different in height by an amount d from each other. The joint portion 331 is connected to the one side edge portion 32A of the connecting plate portion 32 exposed at the fusible element-receiving portion 31A. On the other hand, the joint portion 332 is connected to the other end portion of the corresponding terminal (the terminal portion 34) exposed at the fusible element-receiving portion 31A.

Therefore, even when the fuse box HB of this embodiment is surrounded by various adjacent parts, the fusible elements 33 received in the respective fusible element-receiving portions 31A (covered with the transparent cover 40) can be easily visually recognized through the transparent cover 40. Particularly, this fusible element 33 is formed into the inclined or slanting condition, and therefore even when the fusible element 33 is received in the recess-like fusible element-receiving portion 31A, the lower joint portion 332 projects more toward the front face of the block base portion 31 than the upper joint portion 331, and the intermediate fusible portion 333 is spaced apart from the bottom surface of the fusible element-receiving portion 31A, and therefore whether or not the fusible element 33 is melted can be easily confirmed from the exterior.

Although a method of manufacturing the complex type fusible link 30 of this embodiment is almost similar to the method of manufacturing the complex type fusible link 10 of the first embodiment, the former method differs from the latter method in that in the insert molding, the connecting plate portion 32 and the terminals 34 are set in a mold in such a manner that the height of the terminals 34 is larger by the amount d than the height of the connecting plate portion 32.

Third Exemplary Embodiment

Next, a third exemplary embodiment of the invention will be described with reference to the drawings.

Figure 10:
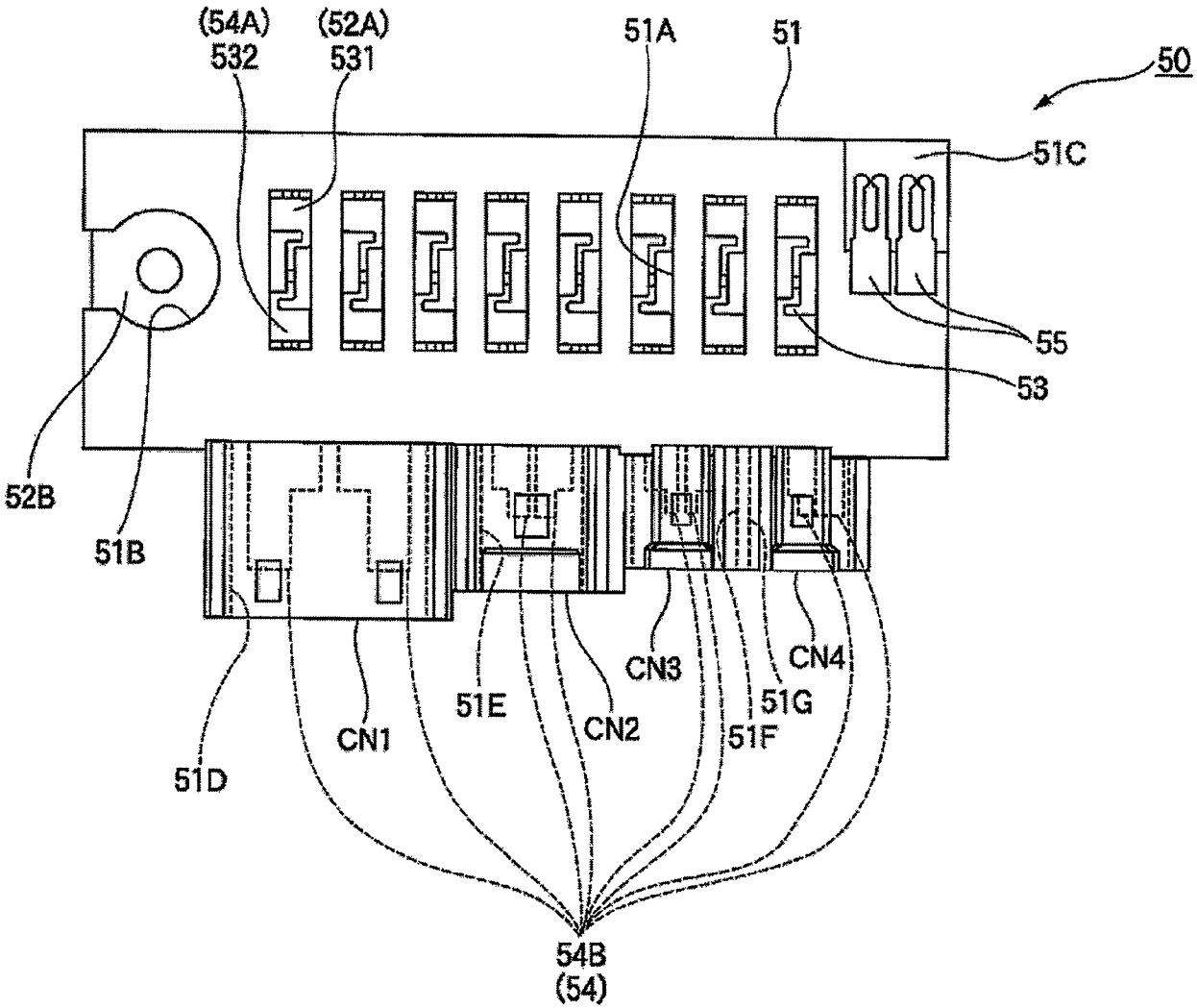
FIG. 10 is a front-elevational view of a third exemplary embodiment of a complex type fusible link of the invention.
Figure 11:
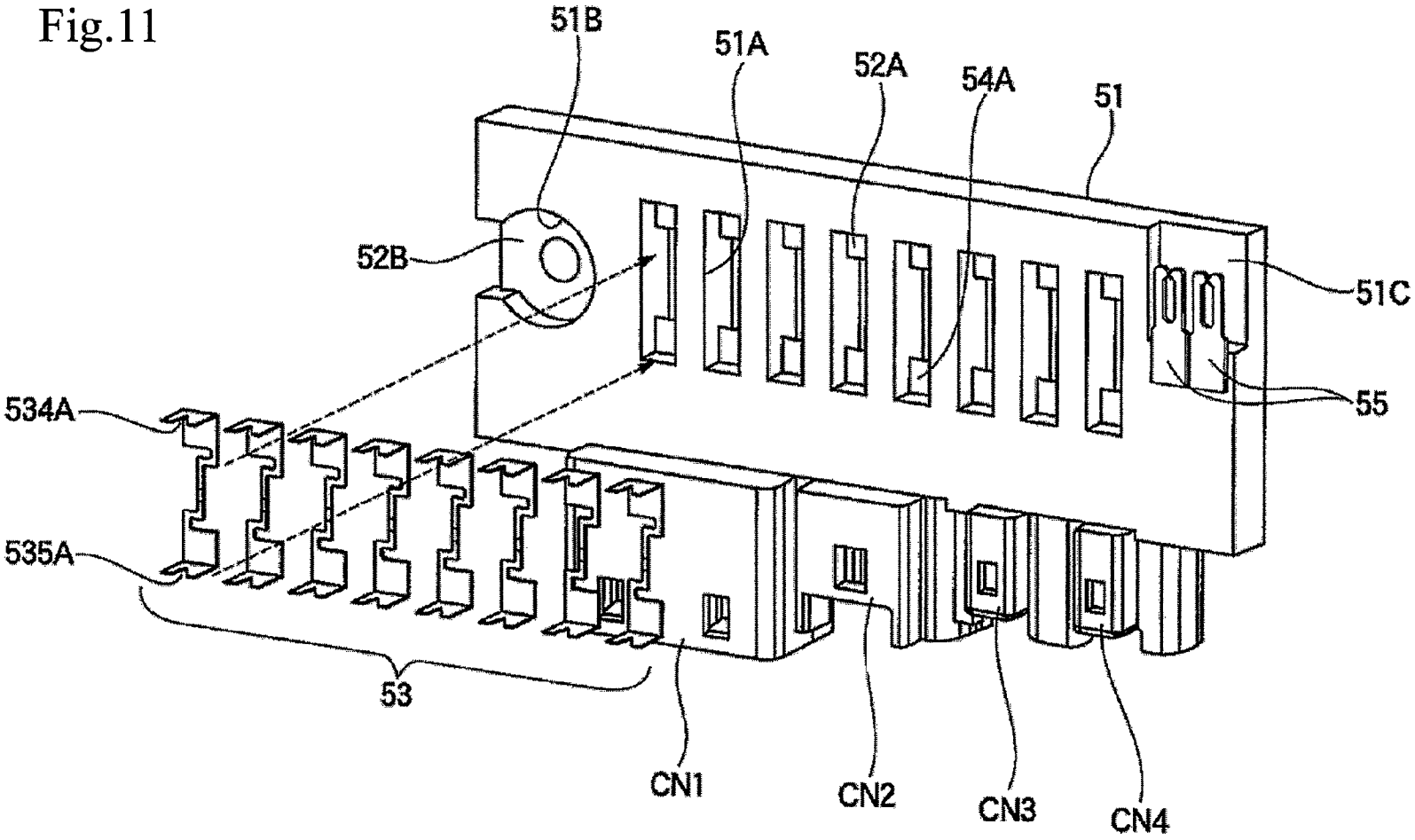
FIG. 11 is an exploded perspective view of the complex type fusible link of the third embodiment.

FIGS. 10 and 11 show a third exemplary embodiment of a complex type fusible link 50, and this fusible link is installed in a power box of a vehicle as in the first embodiment. The complex type fusible link 50 includes a block base portion 51, a connecting plate portion (not shown), fusible elements 53, and terminals 54. In the drawings, reference numeral 55 denotes spare blade fuses.

Like the block base portions of the first and second embodiments, the block base portion 51 is formed into a thin plate-shape or a box-shape, using an insulative resin, and fusible element-receiving portions 51A are formed in a central portion of one face of the block base portion 51, and are arranged at a predetermined pitch in relatively closely-spaced relation. One side edge portion 52A (see FIG. 11) of the connecting plate portion is exposed at the fusible element-receiving portions 51A, and also one end portions 54A of the terminals 54 are exposed at the fusible element-receiving portions 51A, respectively.

A recess 51B for the screw fastening of an ring terminal (not shown) is formed in the one face of the block base portion 51 at one end portion thereof as described above for the block base portion of the second embodiment, and one end portion 52B of the connecting plate portion is exposed at the recess 51B. On the other hand, a step portion 51C for receiving the blade fuses 55 is formed in the one face of the block base portion 51 at the other end portion thereof. The spare blade fuses 55 are fixed to this step portion 51C.

Female type connectors CN1 to CN4 are formed at one side surface (lower surface) of the block base portion 51. Connector chambers 51D to 51G are formed within the connectors CN1 to CN4, respectively, and the other end portions 54B of the terminals 54 project into the connector chambers 51D to 51G in an exposed manner.

The connecting plate portion and the terminals are mostly embedded integrally in the block base portion 51 by insert molding as in the second embodiment. The end portions, etc., of the connecting plate portion and the terminals are exposed to the exterior from the block base portion 51 so as to be electrically connected to the ring terminal and the fusible elements 53 as described above. Namely, with respect to the connecting plate portion, the one side edge portion 52A (see FIG. 11) for being connected to joint portions 531 of the fusible elements 53, as well as the one end portion 52B (see FIGS. 10 and 11) for connection to the ring terminal, is exposed as described above. With respect to the terminals 54, the one end portions 54A (see FIG. 11) for being connected respectively to joint portions 532 of the fusible elements 53, as well as the other end portions 54B projecting into the respective connector chambers 51D to 51G, are exposed as described above.

The fusible element 53 has blades so that when this fusible element 53 melts, a substitute fusible element of another type having equal fuse characteristics (rating) can be connected to the melted fusible element 53 through these blades. Namely, the fusible element 53 of this embodiment includes the joint portions 531 and the 532 for being connected respectively to the one side edge portion 52A of the connecting plate portion and the one end portion 54A of the terminal portion 54, an intermediate fusible portion 533, a pair of upstanding walls 534 and 535 extending perpendicularly respectively from the joint portions 531 and 532, and the blades 534A and 535A of a generally V-shape (serving as fastening means) formed or notched respectively in upper edges of the upstanding walls 534 and 535.

Figure 12A:
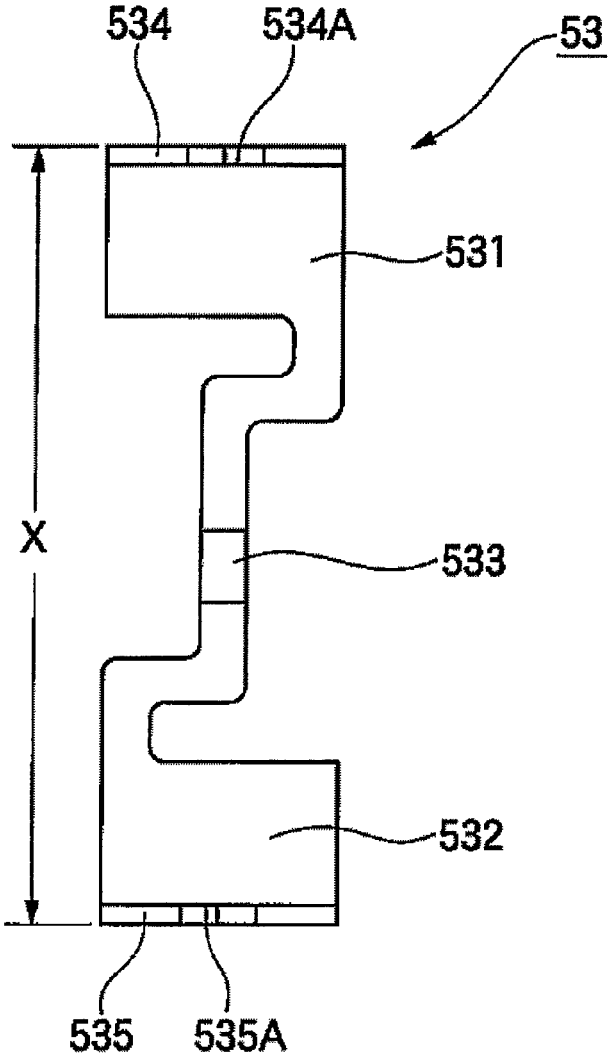
FIG. 12A is a plan view of a fusible element used in the complex type fusible link of the third embodiment.
Figure 12B:
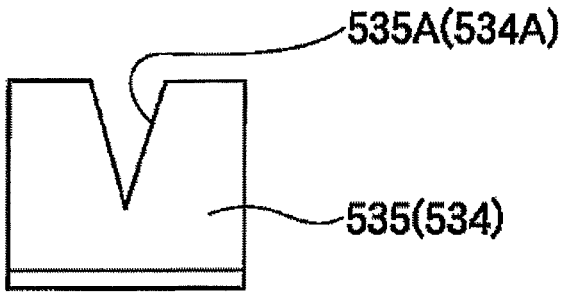
FIG. 12B is a side-elevational view thereof.

When the fusible element 53 melts, the above-mentioned spare blade fuse 55 having the same fuse characteristics (rating) as this fusible element 53 is fastened to the blades 534A and 535A to extend therebetween. By doing so, an operation for exchanging the melted fusible element 53 can be rapidly and easily effected. Therefore, the spare blade fuses 55 equal in fuse characteristics respectively to all kinds of fuses of the fusible elements 53 are provided at the step portion 51C of the block base portion 51 of the block base portion 51 as described above. The spare blade fuse 55 has an overall length X generally equal to the distance X (see FIG. 12) between the blades 534A and 535A. In this embodiment, although the spare blade fuse can be attached to the fusible element by the use of the V-shaped blades, the invention is not particularly limited to this shape and structure, and various modifications can be made.

Figure 13A:
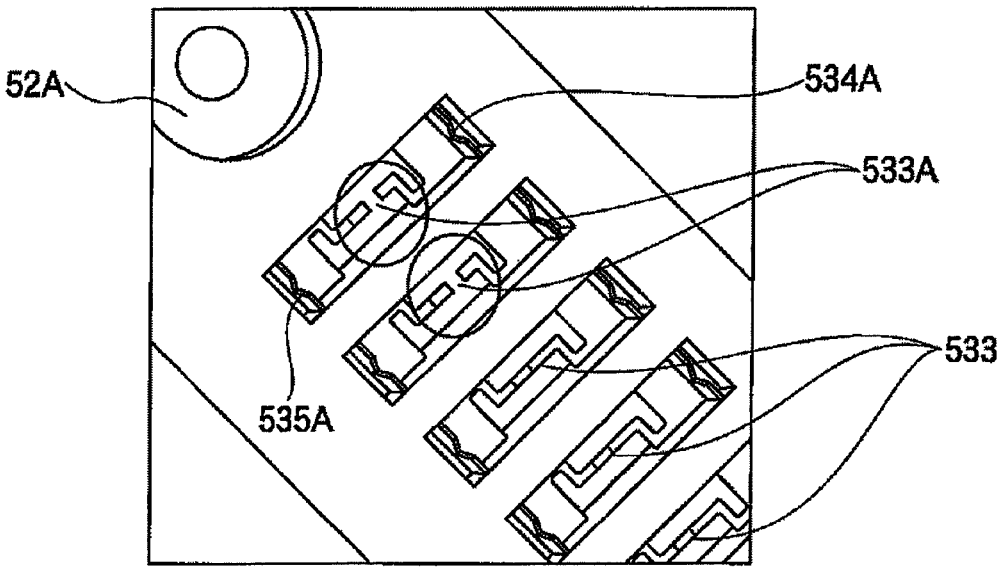
FIGS. 13A and 13B are views explanatory of an operation of the third embodiment.
Figure 13B:
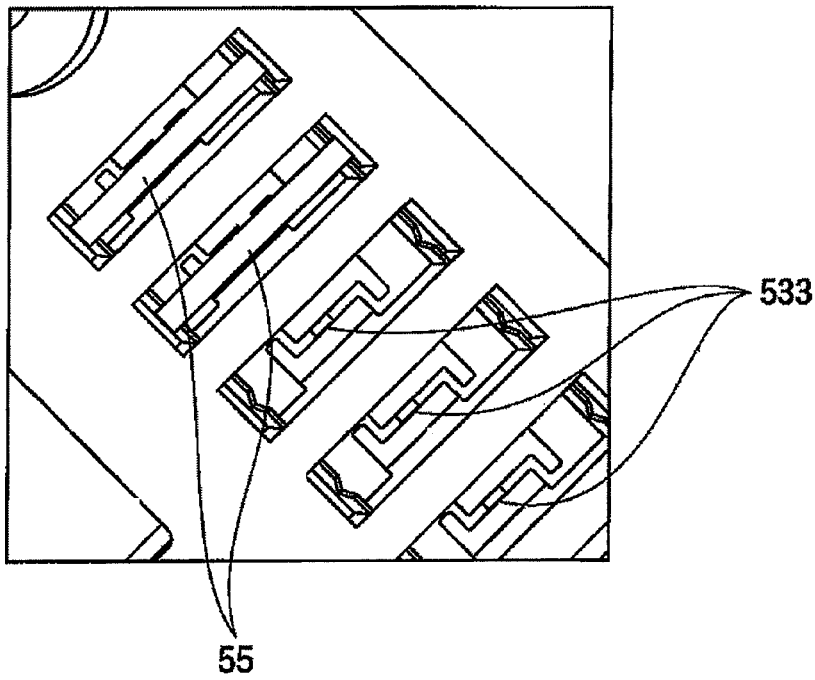
Figure 14:
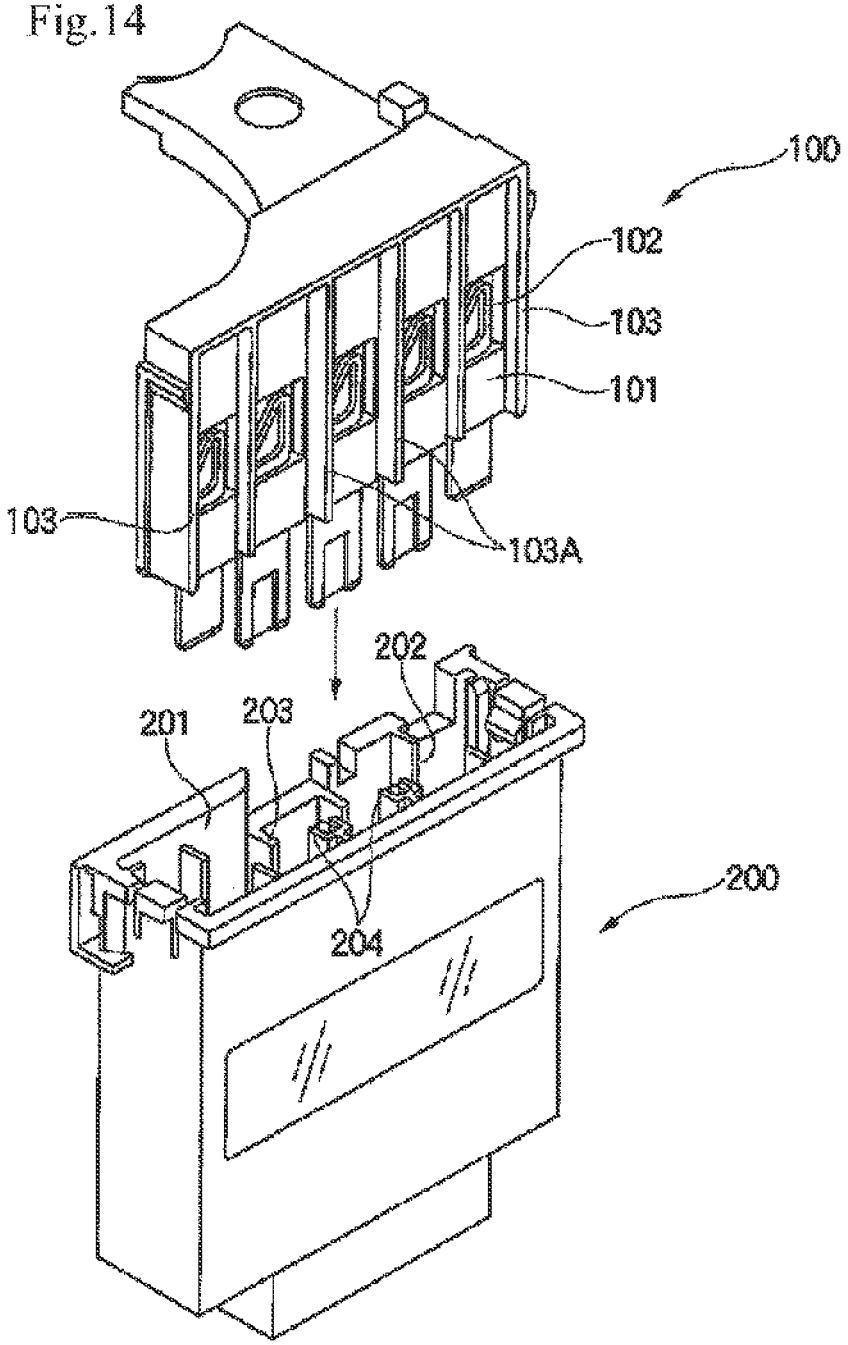
FIG. 14 is an exploded perspective view of a related fuse device.

Therefore, in this embodiment, when a cut-off portion 533A develops in the fusible portion 533 of any of the fusible elements 53, for example, upon flowing of an overcurrent therethrough, the spare blade fuse 55 corresponding in fuse characteristics (rating) to this melted fusible element 53 is selected from the spare blade fuses 55 attached to the block base portion 51, and is removed from this block base portion 51, and is secured to the melted fusible element 53 while leaving this melted fusible element 53 as it is. Namely, the selected spare blade fuse 55 is press-contacted with the blades 534A and 535A formed respectively in the upstanding walls 534 and 535 of the melted fusible element 53, and thus is fixed thereto, thereby achieving the required electrical connection (see FIG. 13B).

Therefore, when a fuse melts, for example, during use of the vehicle, it has heretofore been necessary to connect wires to a new fuse replacing the melted fuse, but in this embodiment the relevant fuse circuit can be easily restored with the above simple operation. The complex type fusible link 50 of this embodiment can be manufactured by a method similar to the method of manufacturing the complex type fusible link 10 of the first embodiment.

Although this embodiment is directed to the fuse box HB with the complex type fusible link for use in the vehicle, the fusible box HB can be used in other vehicles, vessels and airplanes with various electrical equipments, such as a motor cycle, a pleasure boat, a yacht with an outboard engine or an inboard engine and a small-size airplane.

The invention claimed is:

1. A complex type fusible link comprising:

an insulative block base including a plurality of cavities;

a conductive connecting plate which is integrally embedded in the insulative block base, a part of the conductive connecting plate being exposed to at least one of the cavities;

a plurality of fusible elements each of which is accommodated in corresponding one of the cavities and includes a first end which is connected to the part of the conductive connecting plate and a second end; and a plurality of terminals each of which is integrally embedded in the insulative block base and includes a first end which is connected to the second end of corresponding one of the fusible elements and a second end which is exposed from the insulative block base, wherein at least one of the plurality of fusible elements includes a fastening portion, integrally formed with the at least one of the plurality of fusible elements, to which an other fusible element is fastened after the fusible element is melted;

the at least one of the plurality of fusible elements includes a first joint portion being connected to one side edge portion of the conductive connecting plate, a second joint portion being connected to the first end of the terminal, and an intermediate fusible portion provided between the first joint portion and the second joint portion; and the first joint portion and the second joint portion include the fastening portion to which the other fusible element is fastened after the fusible element is melted.

2. The complex type fusible link according to claim 1, wherein the fastening portion includes a V-shaped notch.

3. The complex type fusible link according to claim 1, wherein the insulative block base includes a step portion on a first face to which the other fusible element is removably attached before being fastened to the fastening portion of the fusible element.

4. The complex type fusible link according to claim 1, wherein the other fusible element has a same fuse characteristic as the plurality of fusible elements.

5. The complex type fusible link according to claim 1, wherein the other fusible element is directly fastened to the fastening portion.

6. The complex type fusible link according to claim 1, wherein the fastening portion includes upstanding walls extending perpendicularly respectively from the first joint portion and the second joint portion, and blades formed respectively in upper edges of the upstanding walls.

7. A complex type fusible link comprising:

an insulative block base including a plurality of cavities;

a conductive connecting plate which is integrally embedded in the insulative block base, a part of the conductive connecting plate being exposed to at least one of the cavities;

a plurality of fusible elements each of which is accommodated in corresponding one of the cavities and includes a first end which is connected to the part of the conductive connecting plate and a second end; and a plurality of terminals each of which is integrally embedded in the insulative block base and includes a first end which is connected to the second end of corresponding one of the fusible elements and a second end which is exposed from the insulative block base, wherein at least one fusible element of the plurality of fusible elements includes an upstanding wall extending from at least one of the first end and the second end thereof, wherein the upstanding wall has an end that is distant from the first end or the second end of the at least one fusible element in a direction perpendicular to a surface of the conductive connecting plate that is exposed to at least one of the cavities; and the end of the upstanding wall forms a notched fastening portion to which an other fusible element is fastened.

8. The complex type fusible link according to claim 7, wherein the fastening portion includes a V-shaped notch to which the other fusible element is fastened.

9. The complex type fusible link according to claim 8, wherein the other fusible element has a same fuse characteristic as the plurality of fusible elements.

10. The complex type fusible link according to claim 7, wherein the first end and the second end of the at least one fusible element are distal to a center thereof.

* * * * *